US006060966A

United States Patent [19]

Tennant et al.

[11] Patent Number: 6,060,966

[45] Date of Patent: May 9, 2000

[54] RADIO FREQUENCY FILTER AND APPARATUS AND METHOD FOR COOLING A HEAT SOURCE USING A RADIO FREQUENCY FILTER

[75] Inventors: David T. Tennant, Flossmoor; Kevin J. McDunn, Lake in the Hills; Linda Limper-Brenner, Glenview; Michael K. Bullock, Wauconda, all of Ill.

[73] Assignee: Motorola, Inc., Schaumburg, Ill.

[21] Appl. No.: 08/961,824

[22] Filed: Oct. 31, 1997

[51] Int. Cl.[7] ..... H01P 1/20; F28F 7/00

[52] U.S. Cl. ..... 333/202; 333/99 R; 165/80.4; 361/699

[58] Field of Search ..... 333/202, 219.1, 333/234, 99 S, 99 R; 165/80.4; 174/15.1; 361/699; 257/714

[56] References Cited

U.S. PATENT DOCUMENTS

| | | | |
|---|---|---|---|
| 5,111,170 | 5/1992 | Ohya | 333/219.1 |
| 5,220,804 | 6/1993 | Tilton et al. | 62/64 |
| 5,309,319 | 5/1994 | Messina | 165/80.4 X |
| 5,428,326 | 6/1995 | Mizan et al. | 331/96 X |
| 5,522,452 | 6/1996 | Mizuno et al. | 165/80.4 X |
| 5,675,473 | 10/1997 | McDunn et al. | 165/80.4 |
| 5,805,033 | 9/1998 | Liang et al. | 333/219.1 X |

OTHER PUBLICATIONS

Photos of: RF Cavity Delay Filters by Filtronic Comtek, Fluid Conditioning System Filter by 3M Corp., Spray Cooling Fluid Manifolds and Nozzle Arrays by Motorola and Isothermal Systems Research.

*Primary Examiner*—Seungsook Ham
*Attorney, Agent, or Firm*—Heather L. Creps

[57] ABSTRACT

The filter includes a housing (13) defining a cavity (14). The housing has a fluid inlet orifice (22) and a fluid ou let orifice (24) therein. At least one resonator (16), which is sized to receive and pass a radio frequency signal, is disposed in the cavity. A dielectric fluid (18) fills the cavity. The fluid inlet orifice is configured to supply a first quantity of the dielectric fluid to the cavity and the fluid outlet orifice is configured to remove a second quantity of the dielectric fluid from the cavity, so that the dielectric fluid is continuously replaced.

17 Claims, 1 Drawing Sheet

RADIO FREQUENCY FILTER AND APPARATUS AND METHOD FOR COOLING A HEAT SOURCE USING A RADIO FREQUENCY FILTER

FIELD OF THE INVENTION

This invention relates generally to filters, and, more particularly, to a radio frequency filter and to an apparatus and method for cooling a heat source using a radio frequency filter.

BACKGROUND OF THE INVENTION

RF cavity filters may be used in linear power amplifiers and radio equipment such as cellular base stations, among other things, to, for example, reduce undesired frequencies in an RF signal, or to delay an RF signal by a predetermined amount of time.

Many efforts to reduce the size of devices such as linear power amplifiers and other electronic modules utilizing high-power electronic components and/or RF cavity filters have focused upon increased integration of electronic components. Sophisticated thermal management techniques such as two-phase cooling, which allow further abatement of device sizes, have often been employed to dissipate the heat generated by integrated electronics.

For example, evaporative spray cooling, described in detail in U.S. Pat. No. 5,220,804 to Tilton et al. which is incorporated herein by reference, is a preferred method of heat removal in many electronics applications and its use typically enables product and/or packaging sizes to be significantly reduced.

Generally, however, because RF cavity filters require a specific finite volume (occupied by a dielectric material such as air or oil) to provide a desired frequency response, reduction of product size resulting from electronic integration and advanced thermal management has not significantly impacted the sizes of RF cavity filters.

There is therefore a need for an improved RF filter, and for apparatuses and methods for cooling heat sources using RF filters which will result in reduced sizes of devices incorporating such apparatuses and methods.

SUMMARY OF THE INVENTION

According to an aspect of the present invention, the foregoing need is addressed by a radio frequency filter which includes a housing defining a cavity. The housing has a fluid inlet orifice and a fluid outlet orifice therein. At least one resonator, sized to receive and pass a radio frequency signal, is disposed in the cavity. A dielectric fluid fills the cavity. The fluid inlet orifice is configured to supply a first quantity of the dielectric fluid to the cavity and the fluid outlet orifice is configured to remove a second quantity of the dielectric fluid from the cavity, so that the dielectric fluid is continuously replaced.

According to another aspect of the present invention, an apparatus for cooling a heat source includes a filter configured to receive and pass a radio frequency signal, the filter having a fluid inlet orifice therein. A dielectric cooling fluid is disposed within the filter, and the dielectric cooling fluid is continuously replaceable via the inlet orifice. A nozzle housing is disposed in the filter, the nozzle housing sized to receive a nozzle and having a receptacle end and a spray end. The receptacle end is in communication with the cooling fluid and the spray end is configured to direct the dielectric cooling fluid at a heat source.

According to a further aspect of the present invention, a method for cooling a heat source includes providing a filter configured to receive and pass a radio frequency signal, the filter defining a cavity and having a fluid inlet orifice and a fluid outlet orifice therein; disposing a dielectric cooling fluid in the cavity; continuously replacing the dielectric cooling fluid by supplying a first quantity of the dielectric cooling fluid to the inlet orifice and by removing a second quantity of the dielectric cooling fluid via the outlet orifice; and utilizing the dielectric cooling fluid to cool a heat source.

Advantages of the present invention will become readily apparent to those skilled in the art from the following description of the preferred embodiment of the invention which has been shown and described by way of illustration. As will be realized, the invention is capable of other and different embodiments, and its details are capable of modifications in various respects. Accordingly, the drawings and description are to be regarded as illustrative in nature, and not as restrictive.

DETAILED DESCRIPTION OF THE PREFERRED EMBODIMENTS

Figure 1:
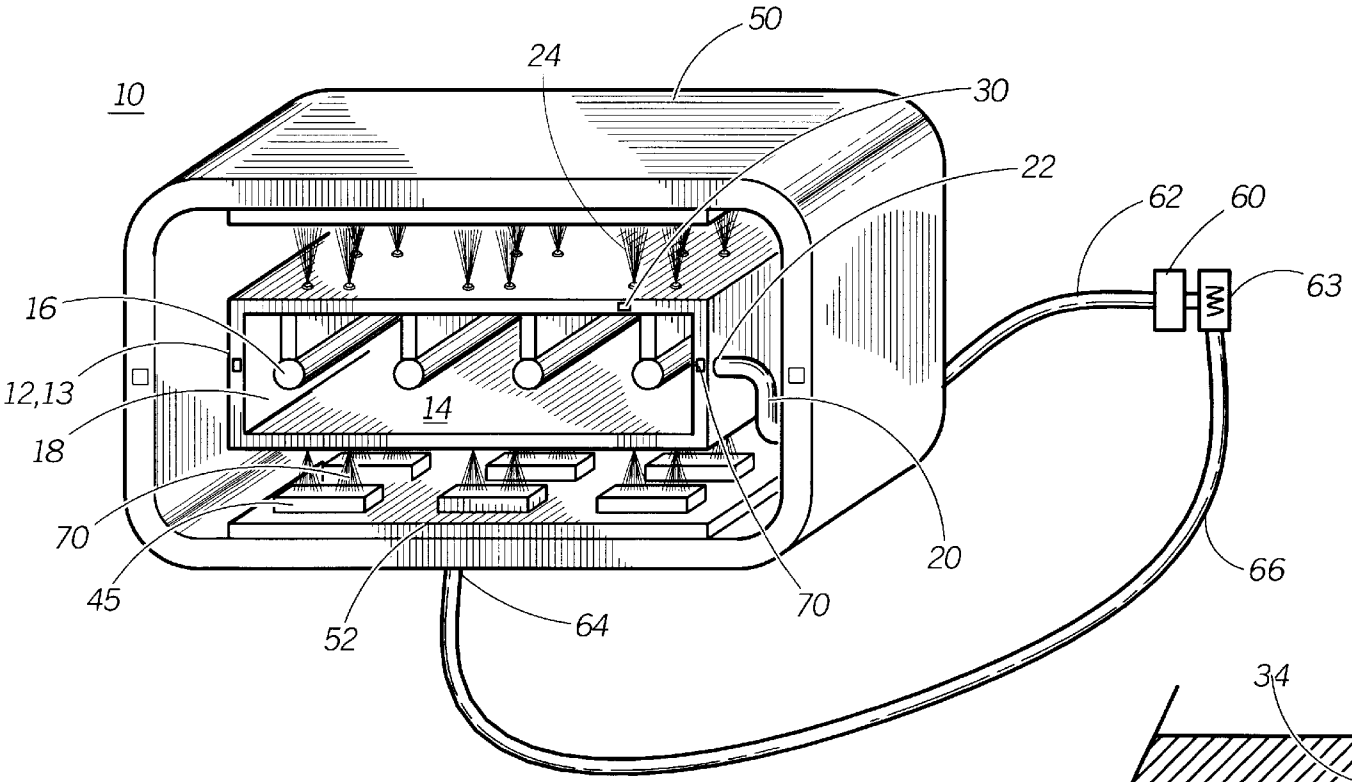
FIG. 1 is a perspective view of an apparatus for cooling a heat source such as an electronic component, which apparatus incorporates a radio frequency filter according to a preferred embodiment of the present invention. A closed loop fluid flow is also shown.

Turning now to the drawings, wherein like numerals designate like components, FIG. 1 is a perspective view of an apparatus 10 for cooling a heat source, according to a preferred embodiment of the present invention. Central to apparatus 10 is a radio frequency (RF) cavity filter 12. Filter 12 is preferably a bandpass filter configured according to well-known methods to have a particular frequency response and certain loss characteristics.

As shown, filter 12 is encapsulated by a device having a device housing 50, which may be made of any material. Also contained by device housing 50 are substrates 52 such as circuit boards, upon which are mounted a variety of electronic components 45. Device housing 50, substrates 52 and electronic components 45 are shown for illustrative purposes only. Filter 12 may operate, for example, in devices such as linear power amplifiers.

Housing 13 of filter 12 defines a cavity 14. Housing 13 may be composed of a metal such as aluminum, which may be further plated with silver, or another material such as metalized plastic.

A plurality of resonators 16 are disposed within cavity 14. Resonators 16 may be made of a metal such as aluminum or a ceramic such as basic activated alumina or another material.

Typically, cavity 14 is filled with a static dielectric material, such as air or oil, having a particular dielectric constant associated therewith. For example, the dielectric constant of air is one (1.0).

In accordance with an aspect of the present invention, however, cavity 14 is filled with a constantly replaceable volume of a dielectric cooling fluid 18 such as a perfluorocarbon fluid. An example of a suitable perfluorocarbon fluid is Fluorinert™ perfluorocarbon fluid, available from 3M, which has a dielectric constant of approximately 1.8.

A fluid supply tube 20 supplies cooling fluid 18 to a fluid inlet orifice 22. A fluid outlet orifice 24 allows fluid 18 to be removed from filter 12. As shown, fluid 18 is removed from filter 12 via a nozzle (discussed further below). Orifices 22 and 24 may be located in any desirable location on filter 12, and suitable locations may vary depending on factors such as orientation of filter 12. In addition, particulate filters may be incorporated within housing 13, or within orifices 22, 24, for the purpose of integrating additional fluid peripherals into RF filter 12.

Because the center frequency of filter 12 is sensitive to the dielectric constant within cavity 14, it is desirable to maintain a constant volume of fluid 18 within cavity 14.

At least one nozzle housing 30 may be disposed in filter housing 13. As shown in detail in FIG. 2, a nozzle housing 30 has a receptacle end 32 which is in communication with fluid 18 (shown in FIG. 1). If desired, an additional fluid distributing manifold may be provided to distribute fluid to receptacle end 32. A spray end 34 of nozzle housing 30 includes an aperture 36.

Each nozzle housing 30 is sized to receive a fluid management device 40. It is contemplated that device 40 is secured to a nozzle housing 30 by, for example, press-fitting, soldering or bonding. Alternatively, an entire nozzle assembly may be integrally formed in housing 13.

Nozzles are preferably miniature atomizers such as simplex pressure-swirl atomizers, and may be made of any suitable material. An example of a suitable material is a metallic material such as stainless steel or aluminum. Simplex pressure-swirl atomizers are described in detail in U.S. Pat. No. 5,220,804 to Tilton et al., incorporated herein by reference, and are commercially available from Isothermal Systems Research, Inc.

Figure 2:
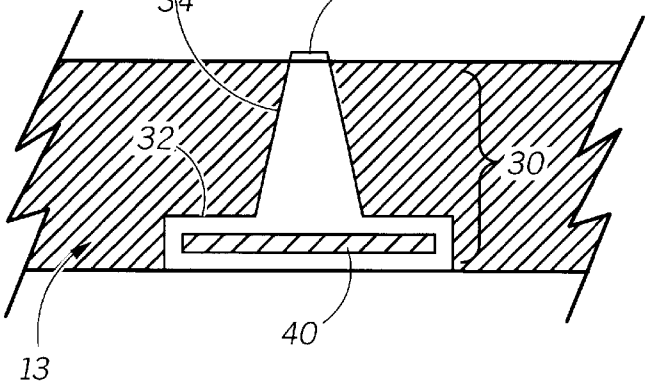
FIG. 2 is a side view of a nozzle housing suitable for use in the device shown in FIG. 1.

During normal operation of the apparatus described herein, referring collectively to FIGS. 1 and 2, a constant volume of cooling fluid 18 is maintained within RF cavity filter 12. A fluid pump 60, which is connected via tube 62 to fluid supply tube 20, supplies fluid 18 to filter 12. Fluid 18 is removed from filter 12 via a plurality of fluid outlet orifices 24 having nozzles associated therewith. In operation, for example, fluid 18 may be supplied to receptacle end 32 of one or more nozzle housings 30 which are fitted with fluid management devices 40. The devices 40, in conjunction with spray end 34, may atomize fluid 18 and discharge the atomized fluid 70 through aperture 36 onto one or more electronic components 45. Perfluoroisobutylene (PFIB) is a potential byproduct of thermal decomposition of perfluorinated carbon liquids such as Fluorinert™. The use of a scavenger material, such as basic activated alumina, in filter 12 may neutralize the PFIB.

After fluid 18 is atomized and discharged onto components 45, it may be collected and removed from housing 50 as appropriate according to the design characteristics of the particular device utilizing filter 12.

A condenser 63, connected to pump 60 and to a fluid outlet port 64 by tube 66, receives fluid from housing 50. Condenser 63 rejects heat from the fluid. Cooled fluid is supplied from condenser 63 to pump 60. Thus, a closed-loop flow of fluid is formed. It will be appreciated that at any given point dielectric cooling fluid 18 may be a vapor, a liquid or a vapor and liquid mixture, although it is desirable for fluid 18 to remain in a single phase, such as a liquid phase, while within filter 12.

The size of fluid pump 60 and condenser 63 should be selected according to well-known methods based on heat removal and flow rate requirements. Pump and condenser assemblies in various sizes are available from Isothermal Systems Research, Inc., and acceptable tubing and fittings may be obtained from Cole-Parmer in Vernon Hills, Ill.

It is, however, contemplated that any conventional means for providing flow of a coolant may be used in conjunction with the described aspects of the present invention, and that fluid may be removed from filter 12 by means other than a nozzle.

Filter 12 serves a dual purpose—it functions as an RF filter and also as a manifold for purposes of fluid routing and pressure equalization. Such a manifold is desirable for successful operation of a cooling system such as an evaporative spray cooling system. Thus, size, part-count and packaging associated with a device which uses both an RF cavity filter and a cooling system may be reduced.

The physics and operation of filter 12 are well-known. For example, the RF impedance of filter 12 is known to be a function of a diameter of resonators 16 and housing 13, along with the dielectric constant of the dielectric material within cavity 14 and the frequency of the RF signal being filtered. It can thus be appreciated that utilizing a perfluorocarbon fluid having a dielectric constant of 1.8 may further reduce the size of a product incorporating an RF cavity filter constructed according to the described embodiments of the present invention—the volume occupied by the filter would be reduced due to the increased dielectric constant.

In addition, other properties of perfluorocarbon fluids, such as their dielectric strength (approximately five times that of air at 0.1 inch spacing and standard temperature and pressure) and low loss tangents, make them ideal candidates for use with RF filters designed as described herein. For example, high dielectric strength allows the voltage that may be sustained within a given RF filter to be increased.

Moreover, the continuous mass transfer of fluid through an RF filter such as filter 12 will contribute to well-controlled operation temperature of the surfaces of cavity 14 and resonators 16. This cooling benefit may enable housing 13 to be made of non-thermally conductive materials such as metalized plastic. Such materials would allow custom-molded configurations and the option of integrating electronic components and other circuitry with housing 13. Low operating temperatures of filter 12 will also result in decreased electrical resistance, which in turn could minimize the cost and complexity of matching coefficients of thermal expansion, especially in frequency-critical applications.

It is contemplated that wherever sealing and/or fastening may be required to realize the various embodiments of the present invention, numerous methods and materials may be used. For example, fasteners, compliant gaskets, ultrasonic welding, brazing, soldering or swaging may be utilized.

It will be apparent that other and further forms of the invention may be devised without departing from the spirit and scope of the appended claims and their equivalents, and it will be understood that this invention is not to be limited in any manner to the specific embodiments described above, but will only be governed by the following claims and their equivalents.

What is claimed is:

1. A radio frequency filter, comprising:

a housing defining a cavity, the housing having a fluid inlet orifice and a fluid outlet orifice therein;

at least one resonator disposed in the cavity, the at least one resonator sized to receive and pass a radio frequency signal; and a dielectric fluid comprising a liquid filling the cavity, the fluid inlet orifice configured to supply a first quantity of the dielectric fluid to the cavity and the fluid outlet orifice configured to remove a second quantity of the dielectric fluid from the cavity, the dielectric fluid being continuously replaced and directed at a heat source external to the radio frequency filter.

2. The radio frequency filter according to claim 1, wherein the dielectric fluid comprises a perfluorocarbon fluid.

3. The radio frequency filter according to claim 2, wherein the perfluorocarbon fluid comprises Fluorinert™ perfluorocarbon fluid.

4. The radio frequency filter according to claim 1, wherein the dielectric fluid comprises air.

5. The radio frequency filter according to claim 1, wherein the at least one resonator comprises basic activated alumina.

6. The radio frequency filter according to claim 1, wherein the housing comprises metalized plastic.

7. An apparatus for cooling a heat source, comprising:

a filter configured to receive and pass a radio frequency signal, the filter having a fluid inlet orifice therein;

a dielectric cooling fluid comprising a liquid disposed within the filter, the dielectric cooling fluid continuously replaceable via the inlet orifice; and a nozzle housing disposed in the filter, the nozzle housing sized to receive a nozzle and having a receptacle end and a spray end, the receptacle end in communication with the cooling fluid and the spray end configured to direct the dielectric cooling fluid at a heat source external to the filter.

8. The apparatus according to claim 7, wherein the heat source comprises an electronic component.

9. The apparatus according to claim 7, further comprising:

a nozzle disposed in the nozzle housing.

10. The apparatus according to claim 9, wherein the nozzle comprises a simplex pressure swirl atomizer.

11. The apparatus according to claim 7, wherein the dielectric cooling fluid comprises a perfluorocarbon fluid.

12. The apparatus according to claim 7, further comprising:

a fluid pump in communication with the fluid inlet orifice; and a condenser in communication with the fluid pump, the condenser receiving the dielectric cooling fluid and supplying the dielectric cooling fluid to the fluid inlet orifice, forming a closed loop fluid flow.

13. A method for cooling a heat source, comprising:

providing a filter configured to receive and pass a radio frequency signal, the filter defining a cavity and having a fluid inlet orifice and a fluid outlet orifice therein;

disposing a dielectric cooling fluid comprising a liquid in the cavity;

continuously replacing the dielectric cooling fluid by supplying a first quantity of the dielectric cooling fluid to the inlet orifice and by removing a second quantity of the dielectric cooling fluid via the outlet orifice; and utilizing the dielectric cooling fluid to cool a heat source external to the filter.

14. The method according to claim 13, wherein the dielectric cooling fluid cools the heat source via a two-phase process.

15. The method according to claim 13, wherein the step of utilizing comprises:

disposing a nozzle in the filter, the nozzle having a receptacle end and a spray end, the receptacle end in communication with the cooling fluid and the spray end configured to direct the cooling fluid at the heat source.

16. The method according to claim 15, wherein the nozzle is disposed in the fluid outlet orifice.

17. The method according to claim 15, wherein the nozzle comprises a simplex pressure swirl atomizer.

* * * * *